United States Patent [19]

Leitch et al.

[11] 4,140,996

[45] Feb. 20, 1979

[54] FUNCTION MONITORING SYSTEM

[75] Inventors: John W. Leitch, Glendale; Steven C. Schemmel; Louis J. Zervakos, both of Phoenix, all of Ariz.

[73] Assignee: Realcom, Ltd., Phoenix, Ariz.

[21] Appl. No.: 810,974

[22] Filed: Jun. 29, 1977

[51] Int. Cl.[2] ..... G08B 19/00

[52] U.S. Cl. ..... 340/52 F; 340/164 B; 340/521

[58] Field of Search ..... 340/52 R, 52 F, 27 R, 340/27 AT, 213 R, 409, 412, 413, 414, 415

[56] References Cited

U.S. PATENT DOCUMENTS

| | | | |
|---|---|---|---|
| 3,949,358 | 4/1976 | Higashi | 340/52 F |
| 4,035,764 | 7/1977 | Fujinami et al. | 340/52 F |
| 4,053,868 | 10/1977 | Cox et al. | 340/52 F |

*Primary Examiner*—Alvin H. Waring
*Attorney, Agent, or Firm*—LaValle D. Ptak

[57] ABSTRACT

A function monitoring system particularly suitable for use in recreational vehicles, boats, and the like uses a multiplexing system with a display panel including a digital display for displaying time of day information. The display panel also has a legend display portion; and an alarm system continuously, cyclically monitors the condition of various functions to be monitored, such as, water supply reserve, holding tank capacity, battery reserve, etc. Whenever one of the conditions being monitored reaches a point where some type of action should be taken, the alarm system causes the legend for that particular function to be displayed adjacent the time of day display. When a more accurate readout of all of the functions being monitored by the system is desired, a readout cycle is initiated; and the time of day clock display is converted to a digital quantity display, representative of the information of the displayed function legend, function-by-function in sequence, until a cycle of all of the functions has been completed. The system then reverts back to a time of day display with selected legend display of alarm conditions.

8 Claims, 6 Drawing Figures

FUNCTION MONITORING SYSTEM

BACKGROUND OF THE INVENTION

Function monitoring systems for display at a convenient location are widely used in a variety of applications. Typically, the modern passenger automobile includes a number of different instruments used to monitor various functions of the automobile. For example, a speedometer and odometer combination is used to record instantaneous speed and the total number of miles traveled, respectively. In addition, instruments or warning lights are generally provided for displaying monitored conditions of oil pressure, remaining fuel capacity, alternator charging, coolant temperature, brake system functions, and the like.

Generally, all of the instruments or warning lights for these various functions are clustered together at a convenient point for ready and frequent review by the driver of the vehicle. Similar systems also are provided for aircraft, trucks and boats. In addition, modern cooking stoves and ovens provide various indicia of whether or not a particular unit is operating at any given time and further provide indicia by means of suitable display panel instrumentation of elapsed time counters, oven temperature displays and the like.

With the rapid increase in the use of recreational vehicles and boats capable of operating as independent mobile dwellings, additional need has arisen for monitoring various functions of the equipment used in such recreational vehicles and boats. Typically, these vehicles are self-contained small homes with water, sewage facilities, heating and cooling systems, propane gas cooking systems and other systems, depending upon the degree of sophistication of the particular motor home or recreational vehicle which is involved.

In the past, the monitoring instruments for the different functions or systems in mobile homes and recreational vehicles have not been conveniently placed at a single location for frequent observation and monitoring. In addition, the different functional systems have utilized different types of display and in many cases, no display at all for some functions. For example, the propane gas supply often is merely indicated by a simple analog gauge located near or on the propane tank itself. Although the generator units for recreational vehicles and motor homes require regular servicing after a relatively low number of hours of operation, no measurement of the actual hours of use is usually employed. Instead, it is necessary for the user of the vehicle to try to remember how many hours the generator has been run in order to determine when it is necessary to service the generator. This is highly inefficient and very often leads to cases where no required regular maintenance is effected; and the only time the generator is serviced is when there is a failure, often caused by lack of regular maintenance.

A particularly irritating problem in the use of recreational vehicles and mobile homes arises in keeping track of the reserve water supply and the state of the holding tanks used to temporarily store the sewage. In most cases, guesswork, based on past experience of use, is the only way of ascertaining how much fluid remains in the water supply tank or is present in the holding tanks. Generally, when this technique is employed, a person does not realize he is out of water until the water tank runs dry or that the holding tanks are full until they actually overflow or are nearly ready to do so. Neither of these conditions is tolerable for enjoyable use of the motor home.

Systems for providing indications of the liquid levels in the holding tanks and in the water tanks of mobile homes have been devised in the past. Generally, these systems employ different sets of spaced electrical contacts in the water tank and holding tanks. The contact sets are located at levels in the tanks indicative, for example, of one-fourth, one-half, and three-fourths levels of fullness. Direct current circuits connected across the contact sets in series with indicating lights or other direct current display instrumentation is employed. When the liquid level bridges the different sets of contacts, the indicator lights are illuminated; so that the user can have a fair idea of the remaining water supply in the water tank or the reserve capacity remaining in the holding tanks. A problem arises with the use of such indicating systems, however, inasmuch as the direct current flowing through the contacts causes electrolysis of the contacts, resulting in their relatively rapid deterioration. For mobile homes which are extensively used, the indicating systems often deteriorate to an unusable or unreliable condition within less than a year. When the electrolysis of the contacts reaches a point where they become unreliable, it is necessary to completely overhaul that portion of the system at substantial expense.

As a consequence, it is desirable to cluster the display indicia for monitoring various functions in a mobile home or recreational vehicle at a single convenient location and to improve the operation and reliability of the monitoring system itself in a manner which overcomes the disadvantages of the prior art systems mentioned above.

SUMMARY OF THE INVENTION

Accordingly, it is an object of this invention to provide an improved function monitoring system.

It is an additional object of this invention to provide an improved electronic function monitoring system.

It is another object of this invention to provide a monitoring system with an improved display panel.

It is a further object of this invention to provide an improved function monitoring system which provides a visual indication of alarm conditions of various functions being monitored.

It is still another object of this invention to provide an improved function monitoring system which has a digital display for cyclically displaying digital indicia in conjunction with legend indicia of various functions being monitored by the system.

In accordance with a preferred embodiment of this invention, a function monitoring system includes a multidigit digital display which displays digital data in response to input signals applied to it. A time of day clock circuit is coupled to the digital display for normally displaying the time. Located on the display are additional function legend display indicia which are energized in response to operation of a function monitoring system to indicate an alarm condition or in conjunction with the digital display to indicate the state of the various functions monitored by the system. Further provision is made for sequentially displaying the state of each of the functions monitored by the system through the digital display and through the activation of the function legend display, so that all of the systems monitored can be reviewed upon demand.

DETAILED DESCRIPTION

Figure 1:
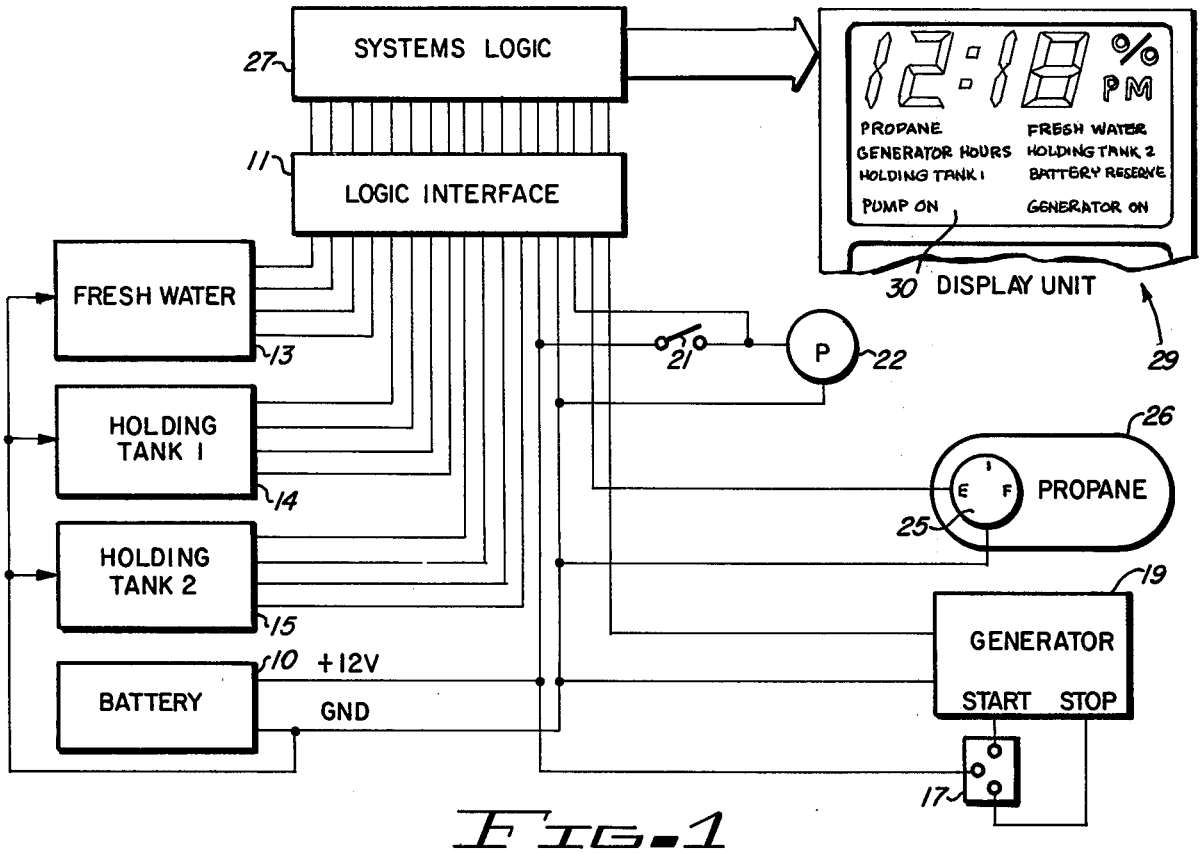
FIG. 1 is a block diagram of a system in accordance with a preferred embodiment of this invention.

Referring now to the drawings, the same reference numbers are used throughout the different figures to designate the same or similar components. FIG. 1 is a block diagram of the system as it typically is used in a motor home of a type currently in widespread use. Such motor homes include various subsystems which enable them to be completely self-contained dwelling units. Some of these subsystems include a propane tank used for cooking and/or heating purposes. A generator for providing auxiliary power is often used, and auxiliary batteries are employed to provide the direct current source of electricity for various systems in the motor home when the motor home is parked or stationary. In addition, tanks are provided for storing a fresh water supply and for storing sewage and waste materials.

In FIG. 1 a monitoring system is shown for monitoring the condition of the various functions or subsystems which are employed in a motor home. For example, a battery 10 supplies the 12 volt direct current power used in the motor home and this power also operates the monitoring system. The power supplied by the battery 10 is furnished to a logic interface circuit 11 which in turn supplies operating potential to, and receives signals from, a fresh water tank supply monitoring circuit 13, a holding tank "1" monitoring system 14, and a holding tank "2" monitoring system 15. In addition, the battery 10 supplies power to a start/stop switch 17 used to operate a generator 19 and it supplies power to an on/-off switch 21 used to operate a pump 22 coupled to the water supply system to supply water under pressure to the various water outlets used in the motor home. The logic interface circuit 11 also interfaces with an analog sensor or gauge 25 located in a propane gas supply tank 26 to receive signals from the sensor 25 indicative of the amount of gas remaining in the tank 26.

The signals from the logic interface 11 which are obtained from the various function monitoring systems connected to it are supplied to a systems logic circuit 27, which includes multiplexing circuitry for controlling the operation of a display panel 29. The panel 29 includes portions for indicating time of day or percentage capacity or other digital indicia representative of the condition of various ones of the functions being monitored. In addition, the panel 29 displays selectively activated indicia which uniquely identify the different functions being monitored. These latter indicia preferably are in the form of words which are displayed whenever attention is to be called to the monitoring of the particular function represented by the words. For example, the word "propane" appears on the display panel 29 whenever the propane supply is low (an alarm condition) or whenever a readout of the percentage of propane remaining in the tank is being effected on the digital indicia portion of the display. Similar indicia are used for the other functions being monitored, and these are shown in FIG. 1 on the display 29.

Figure 2:
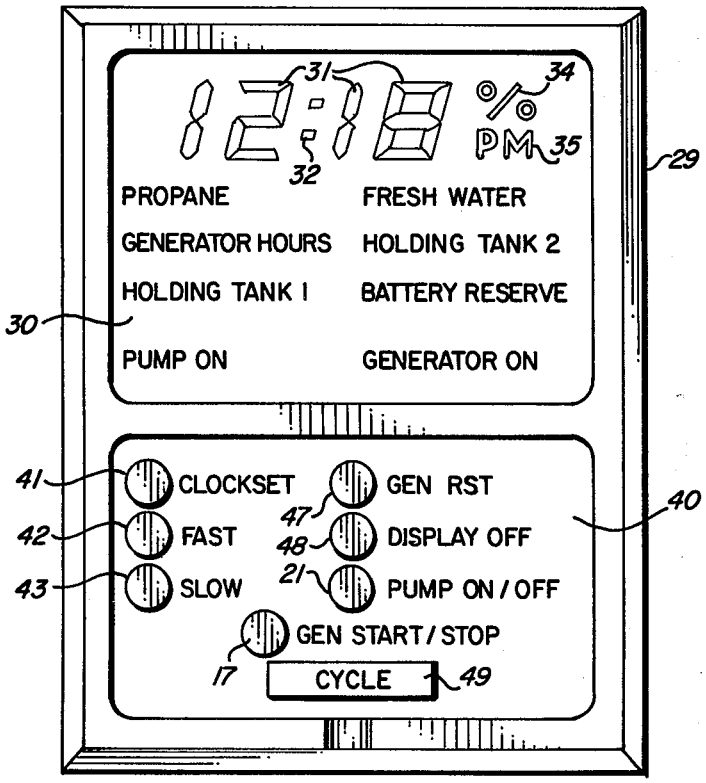
FIG. 2 is an illustration of the display panel and associated switch control panel used in conjunction with the system shown in FIG. 1.

FIG. 2 is a more detailed representation of the display 29, along with a representation of the different control switches which are used in conjunction with the system to set it and to effect various modes of operation from it. As shown in FIG. 2, the display panel 29 includes a display face 30, which preferably is in the form of a liquid crystal display face. None of the display indicia shown on the display 30 of FIG. 2 are visible unless appropriate signals are applied to the various display areas to cause these areas to become visible. The signals which activate the different portions of the display are controlled by the systems logic circuit 27, described in greater detail subsequently in conjunction with FIGS. 3 through 6.

The upper portion of the display panel 30 includes a typical seven-segment digital display portion 31 for displaying four digits, used in the normal operation of the system to show the time of day. The four digits are separated into two groups by a colon 32 which typically is pulsed every second to indicate to the system user that the system is operating. At the right-hand end of the four digits used to display the time are two other symbols, namely the "%" symbol 34 and a symbol "PM" 35. These symbols are not visible when the seven-segment digital display numbers 31 are used to show the time of day in the AM or morning.

When the clock circuit is operating in the afternoon or "PM" portion of the day, the indicia "PM" is energized and becomes visible. As is more apparent from the subsequent description of the detailed circuit, the digital display segments 31 also are used to provide a readout of the state of the different functions being monitored. When this readout is employed, the "%" symbol 34 is activated in conjunction with selected ones of the seven-segment digital display numbers 31 to indicate the percentage of capacity of different ones of the functions being monitored. Some of the functions monitored by the system are not monitored in terms of percent of capacity, and for those functions neither the "PM" symbol nor the "%" symbol 34 are activated; but digital numbers indicative of the monitored condition is displayed.

Under normal conditions of operation, the remaining indicia which are shown on the display face 30 in the form of words or different groups of words are not visible. An alarm circuit, however, continuously monitors the functions which are represented by these words; and whenever an alarm condition is sensed, that is, a condition which should be called to the attention of the operator, the appropriate word or group of words on the display face 30 is made visible. Preferably, this is done in a flashing on/off continuous cycle of operation to call the attention of the operator to the display face 30 of the monitoring system. However, the indicia could be simply activated or turned on and left on until the alarm condition is remedied.

Located below the display face 30 of the indicator panel 29 is a control switch panel 40. The switch panel 40 preferably is located behind a normally closed door (not shown) and includes controls for performing various operations of the systems used to operate the display indicia on the display face 30. For example, a "clock set" switch 41 is used whenever it is desired to change or set the time of day displayed by the clock circuit on the digital display digits 31. In conjunction with the clock set button or switch 41 is a "fast" clock set switch 42 and a "slow" clock set switch 43. If only a minor adjustment (less than an hour) of the clock timing display is required, the "slow" switch 43 is depressed to cause the minutes indicia of the displayed time to advance one minute per second. The "fast" switch 42 is used to advance the hours portion of the displayed time on the panel 30 at the rate of one hour per second. At the display of the "hour" indicia of twelve (12) the "PM" indicator 35 changes state.

In addition to the controls for setting or resetting the time of day displayed on the display face 30, another push button switch 17 for starting and stopping the operation of the generator is used. In addition, as is described more fully hereafter, there is an hours counter which is operated in conjunction with the generator 19; and whenever the generator has been serviced and is to commence a new service cycle; a generator reset push button switch 47 is operated to reset that counter. The switch 21 for controlling the on/off operation of the pump 22 also is located on the panel 40, as is a switch 48 used to turn off the display when the motor home is not in use. It should be noted that when the switch 48 is used to deactivate or turn off the display indicia which are displayed on the display face 30, the time of day clock circuit continues to operate. In addition, the indicia for the "pump on" and "generator on" are not affected by the operation of the display "off" switch 48; so that if either of these devices are operating, the user of the motor home can tell this even though the display is otherwise deactivated or turned off.

The final control switch which is placed on the switch panel 40 of the indicator panel 29 is a "cycle" switch 49. This switch is depressed to initiate a readout cycle of all of the functions monitored by the system in a sequential pattern to activate the selected indicia such as "holding tank" or "battery reserve" on the display face 30, while simultaneously presenting a digital indication of the state of the particular system function being monitored on the seven-segment digital readout portion 31 of the display face 30. Once a complete readout cycle of all of the functions which are monitored by the system is completed, the various indicia represented by the function words on the display face 30 are turned off (unless an alarm condition exists); and the digital display numbers 31 once again are controlled by the time of day clock circuit to display the time of day.

Figure 3:
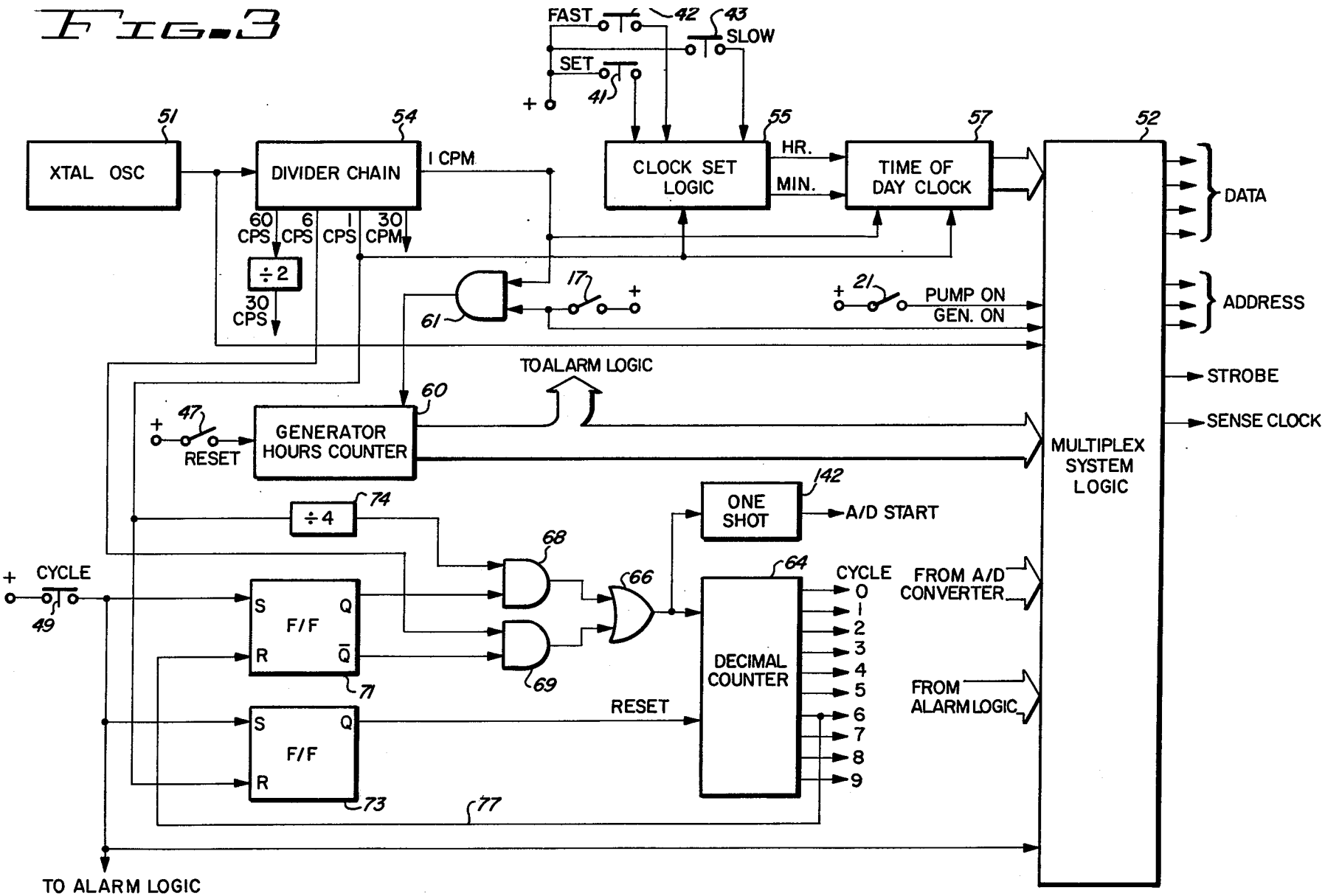
FIGS. 3 through 6 are a more detailed block diagram of the system of FIG. 1.

Reference now should be made to the detailed circuit diagram shown in FIGS. 3, 4, 5 and 6. FIG. 3 shows the portion of the system used to provide the timing functions for the operation of the remainder of the system. The timing control for the entire system, including the time of day circuit, is obtained from a stable, high-frequency, crystal oscillator 51 which, in a commercial application of the system, operates at a frequency of 3.579 megahertz. Output signals at this high frequency are applied to a multiplex system logic circuit 52 to operate as clock or control signals for the multiplex system. These signals also are supplied to a suitable divider chain circuit 54 which supplies output signals at various frequencies indicated on the outputs from the divider chain 54 in FIG. 3. Clock signals at one cycle per second are supplied to the clock set logic circuit 55 which, as stated previously, is operated to set a time of day clock circuit 57. The circuit 57 may be of any suitable conventional type which effects the display of the correct time of day on the display face 30. The clock set logic circuit 55 merely comprises a suitable set of gates for passing the one cycle per second pulses from the output of the divider chain 54 on one or the other of two outputs identified as the hours output "HR" or minutes "MIN" to the time of day clock logic circuit 57. No pulses are passed through the clock set logic circuit 55 unless the "set" switch 41 is operated. The pulses then are passed to the selected output in accordance with whether or not the "fast" set switch 42 or the "slow" set switch 43 is operated.

The operation of the time of day clock circuit 57 is conventional and is effected by the one cycle per minute output pulses from the divider chain 54 and the one cycle per second output pulses from the divider chain 54. For a clock display of the type illustrated in FIGS. 1 and 2, the advancing of the display numbers is controlled solely by the one cycle per minute pulses. The colon indicia 32, however, is flashed at one cycle per second rate; so that a person using the system has a ready indication that the clock is in fact properly functioning at any time the display is observed. That is the reason the one cycle per second pulses are applied to the time of day clock circuit 57.

A generator hours counter 60, which may be of any suitable type, also is operated in response to the one cycle per minute pulses from the output of the divider chain circuit 54 when these pulses are permitted to pass through an AND gate 61. Normally, the pulses are blocked; but when the generator on/off switch 17 is closed to operate the generator (via a circuit not shown), the AND gate 61 is enabled to pass the one cycle per minute pulses from the output of the divider chain 54 to the generator hours counter 60. These pulses then cause the generator hours counter 60 to provide a count of hours and minutes indicative of the number of hours the generator has been operated. The outputs of the various counter stages in the counter 60 are applied in parallel to the multiplex system logic 52 as one set of inputs for that logic and also are applied to the alarm logic circuit for operation of that circuit in response to the attainment of a preestablished count by the counter 60. The generator hours counter 60 is reset to zero or some initial count by the closure of the generator reset switch 47. This generally is done after the generator 19 has been serviced to initiate a new cycle of operation of the counter 60 to record the hours the generator is used following each maintenance or servicing operation.

It also should be noted that the signal obtained by the closure of the "generator on" switch 17 is supplied to the multiplex system logic, and this signal is processed by the logic 52 to energize the "generator on" indicia on the display face 30 of the display panel 29. A similar signal is obtained from the closure of the pump on/off switch 21 to supply a signal to the multiplex logic 52 used to energize the "pump on" indicia on the display face 30.

A decimal counter circuit 64 is continuously operated to provide a step by step sequence of output signals on ten output terminals identified in FIG. 3 as cycle "0" through cycle "9". These outputs are provided sequentially at a rate determined by the rate at which stepping or input pulses are applied to the input of the counter 64 from the output of an OR gate 66. The OR gate 66 in turn has two inputs obtained from one or the other of a pair of AND gates 68 and 69.

Under normal operation of the system, that is, when the time of day clock 57 is controlling the digital display of the numbers 31 on the display face 30, and the system is operating in its automatic mode to monitor all of the various functions to determine whether there is an alarm condition, the pulses applied through the gate 66 to the decimal counter 64 are passed by the AND gate 69. The gate 69 is enabled during this mode of operation by the $\overline{Q}$ output of a control flip-flop 71, and the clock pulses which are applied to the other input of the gate 69 are the six cycle per second (6 CPS) clock pulses from the divider chain 54. As a consequence, thirty-six complete cycles of operation of the decimal counter 64 take place each minute when the system is operating in this mode of operation.

Whenever a readout cycle of the function monitoring system is desired, the "cycle" switch 49 is momentarily closed to change the state of the flip-flop 73 to its "set" state of operation, causing its output to go high to reset the decimal counter 64 to zero. This is done at the commencement of each operation of the "cycle" switch 49 to insure that the cycle operation always begins with the first of the monitored functions and continues through to the last or terminal one of the functions before the system is reset. The next one cycle per second (1 CPS) pulse which is obtained from the output of the divider chain circuit 54 then is applied to the reset input of the flip-flop 73 to place it back in its normal "reset" mode of operation.

When the flip-flop 71 changes from its "reset" to its "set" state of operation, the AND gate 68 is enabled; and the AND gate 69 is disabled. Thus, the pulses for advancing the decimal counter 64 applied through the OR gate 66 then are obtained from the AND gate 68. The clock pulses applied to the second input of the AND gate 68 are supplied from the one cycle per second (1 CPS) output of the divider chain circuit 54 through a divide-by-four divider circuit 74, so that these pulses now occur at the rate of one pulse every four seconds. When the output cycle "6" of the decimal counter 64 is reached, a reset pulse is applied over a lead 77 to the reset input of the flip-flop 71 causing it to be placed back in its initial mode of operation, and the system returns to its normal or automatic mode.

The signal pulse which is obtained upon initial closure of the "cycle" switch 49 also is applied to the multiplex system logic circuit 52 which then switches control of the signals on the four data outputs and the address outputs from the time of day clock circuit 57 to the function monitoring system for displaying the digital percentage indicia corresponding to the various functions in coincidence with the sequential enabling or energization of the different function indicia on the display panel 30. The manner in which this switching is accomplished by the circuit 52 from one set of data inputs to another is conventional and may be achieved in a number of conventional ways. The output from the cycle switch 49 also is applied to the alarm logic shown in FIG. 5. The manner in which this signal affects the operation of that circuitry is explained subsequently.

Figure 4:
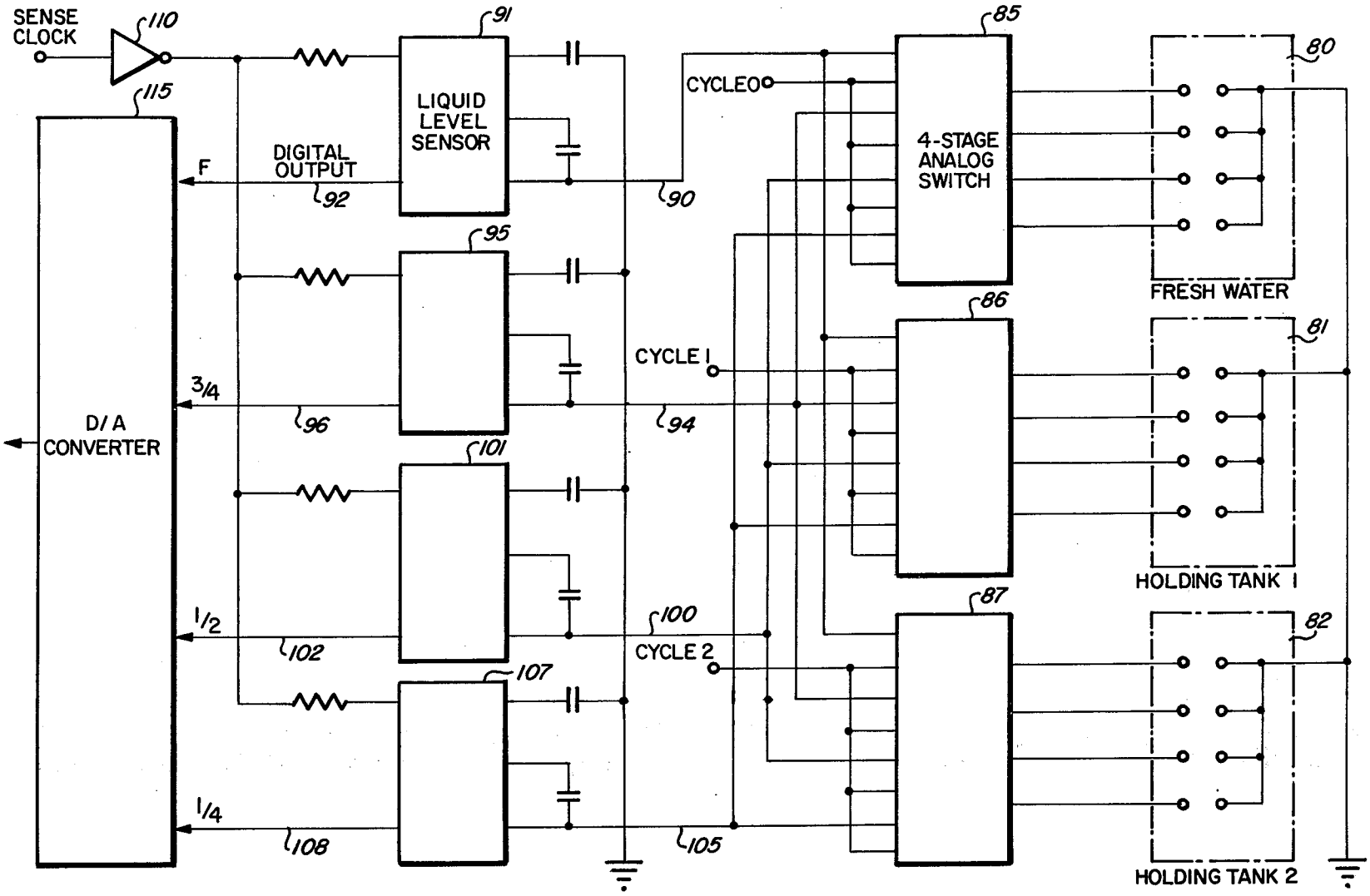

Reference now should be made to FIG. 4 which illustrates the circuits used to provide the sensing signals indicative of the conditions of the fresh water tank 80 and the two different holding tanks 81 and 82 which are identified as "holding tank 1" and "holding tank 2". Each of these tanks has vertically spaced in it four sets of spaced apart contacts which are illustrated within the dotted lines indicating the tanks 80, 81 and 82. The right-hand contacts of all of the contact sets are connected to ground, and four mating or cooperating contacts of the contact sets in each of the tanks 80, 81 and 82 are connected to the respective four inputs of three four-stage analog switches 85, 86 and 87, respectively.

The location of the spaced contact sets within each of the tanks 80, 81 and 82 is chosen so that the lowermost set of contacts are bridged by the liquid in the tank whenever the tank is 25% full. The second lowermost set of contacts is bridged by liquid in the tank when the tank is 50% full, the next set when the tank is 75% full and the top set when the tank is 100% full. Each of the four-stage analog switches 85 through 87 has four signal outputs which are indicative of these same liquid levels. Whenever the contacts representative of these different liquid levels are bridged by liquid, thereby establishing an electrical circuit across the respective contacts of the bridged set of contacts, a signal may be passed by the corresponding level of the analog switches 85, 86 and 87 to the corresponding signal output.

All of the "100%" outputs of the switches 85, 86 and 87 are connected together, and these are indicated as the uppermost outputs of these switches. The common output indicative of full or 100% tank liquid level is applied over the common lead 90 to a liquid level sensor switch 91, the output of which is a digital output applied on a lead 92 at the time any one of the analog switches 85, 86 or 87 is enabled to pass a signal through the switch indicative of the selected level. Similarly, the 75% level output from all of the switches 85, 86 and 87 is applied over a lead 94 to a liquid level sensor circuit 95 which produces a digital output representative of this level on an output lead 96. The 50% level is applied from the analog switches over a lead 100 to a liquid level sensor switch 101 having an output lead 102. Finally, the 25% or one-fourth level is applied over a common lead 105 to a liquid level sensor circuit 107 having an output lead 108.

All of the liquid level sensor circuits 91, 95, 101 and 107 are of the same type and preferably are liquid level sensing circuits of the type manufactured by the National Semiconductor Company and identified as LM1830. These circuits each are supplied with a sequence of relatively high frequency clock pulses from the "sense clock" output of the multiplex system logic 52. These pulses are divided down from the clock pulses applied to the multiplex logic 52 from the output of the crystal oscillator 51 and are square wave pulses passed through a buffer amplifier inverter 110 to the inputs of each of the liquid level sensor circuits 91, 95, 191 and 107. The liquid level sensor circuits in turn cause these signals to be applied as alternating current signals over the respective leads 90, 94, 100 and 105 to the four-stage analog switches 85, 86 and 87. The signals are passed through the analog switches 85, 86 and 87 whenever any one of these switches is enabled by an enabling input obtained from the respective output of the decimal counter 64. For example, the switch 85 is enabled during the output of the decimal counter correspoinding to cycle "0". Similarly, the switch 86 is enabled during cycle "1" and the switch 87 is enabled during cycle "2".

Whenever liquid in any of the tanks bridges a respective set of contacts coupled to its corresponding analog switch, the alternating current signals passed by an enabled analog switch makes a completed circuit through the contacts so bridged to ground and back again. The signals are sensed by the liquid level sensor circuit corresponding to that level (or levels) in the enabled switch to provide an output on the respective one (or ones) of the leads 92, 96, 102 or 108 comprising the four inputs to a digital-to-analog converter circuit 115.

Because only one set of the analog switches 85, 86 or 87 is enabled at any one time, the outputs supplied to the digital-to-analog converter 115 during cycle "0" correspond to a readout of the fresh water supply. During cycle "1", the readout applied to the input of the digital-to-analog converter 115 is for the holding tank 1 by way of the analog switch 86 and during cycle "2" the signals applied to the input of the converter 115 are those from the holding tank 2 by way of the analog switch 87. The output of the digital-to-analog converter 115 is always representative of the highest level of input signals applied to its inputs at any given time, which is the desired condition for subsequent processing of the output signal from the converter 115.

Figure 5:
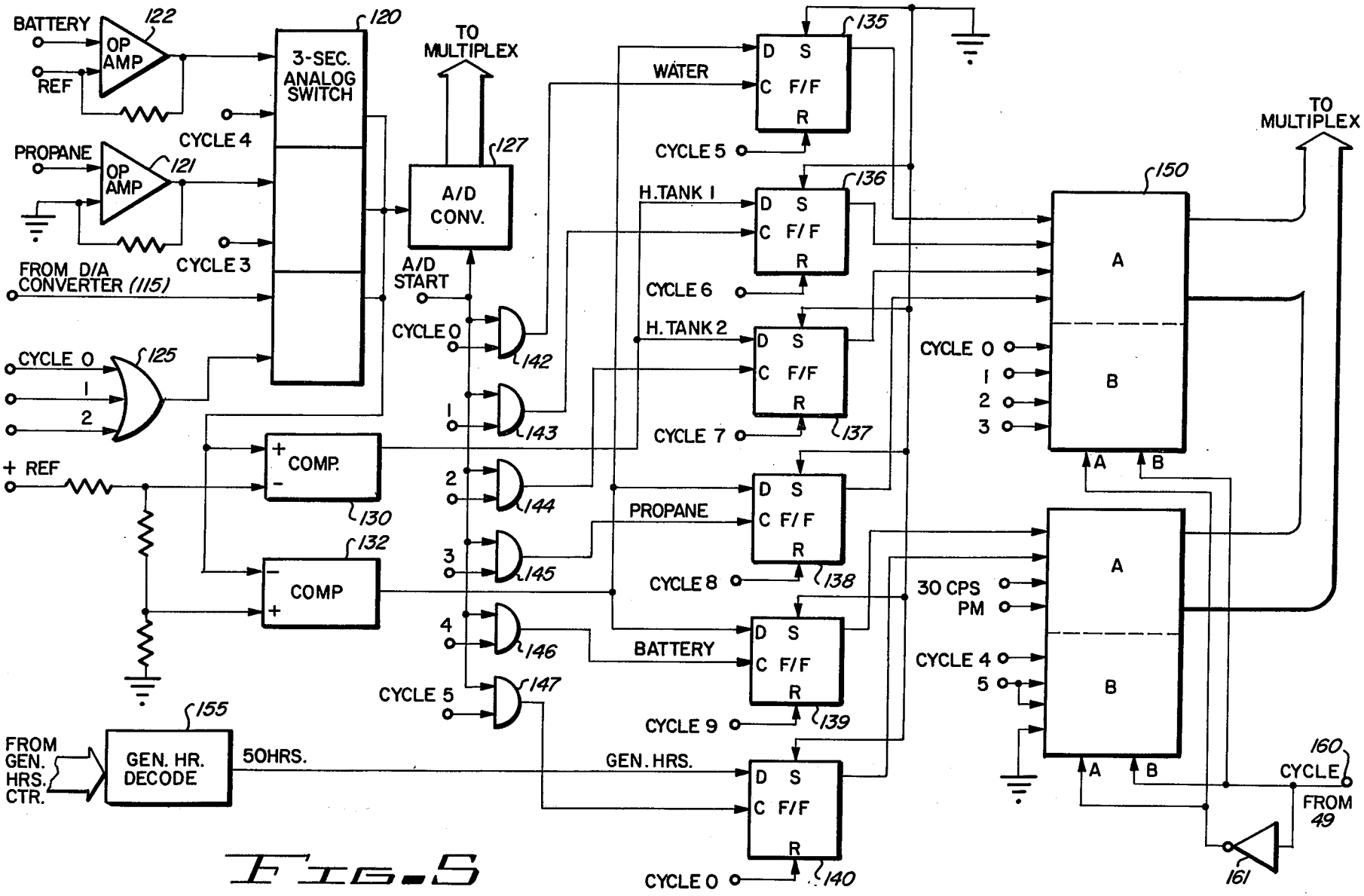

Reference now should be made to FIG. 5 which shows the circuitry used in sequentially sampling the various systems or functions being monitored for display on the display panel 29 during the "cycle" mode of operation and also for operating the alarm circuit to provide alarm indicia during the automatic or normal operation of the system when the time of day display is used to control the digital display digits 31 on the display face 30. In the circuit of FIG. 5, the information from the different function sensors is applied to one of three different sections of a three section analog switch 120. As illustrated in FIG. 5, the lowermost section of the switch 120 is supplied with input signals obtained from the output of the digital-to-analog converter circuit 115 of FIG. 4. Similarly, the analog signal input to the center section of the switch 120 is supplied from an operational amplifier circuit 121 which is connected to the float or meter 25 in the propane tank 26 to supply an analog indication to the center section of the switch 120 representative of the level of fuel left in the propane tank 26. The uppermost section of the switch 120 is supplied with a signal from the battery 10 through an operational amplifier 122, the output of which is representative of the reserve voltage capacity of the battery.

The analog input signals to the lowermost of these three switch sections are representative of the same four conditions which have been discussed previously in conjunction with FIG. 4, namely 25% (one-fourth), 50% (one-half), 75% (three-fourths) or 100% (F) of whatever condition is being monitored. For the battery 10, a continuous range of percentage of the voltage reserve is supplied to the switch 120 where, for a 12 volt battery, a voltage reserve of 10.2 volts is considered 0% with the F or 100% level being displayed at 14.4 volts. The reference signal applied to the second input of the operational amplifier 122 is selected to provide this desired range. A similar result is obtained from the operation of the operational amplifier 121 for the various levels of propane fuel left in the tank 26.

Different ones of the three sections of the analog switch 120 then are enabled to pass the input signals to the switch during different ones of the cycle outputs from the decimal counter 64 to a common output. For example, the lowermost section of the switch 120 is used to read the outputs from the digital-to-analog converter 115, in synchronism with the signal inputs applied to the converter 115, during each of the first three cycles "0", "1", and "2" of the decimal counter 64. These three cycle signals are all passed through an OR gate 125 to enable the lowermost section of the analog switch 120 to pass the output present from the digital-to-analog converter 115 through to the common output of the analog switch 120 during cycles "0", "1" and "2". Similarly, during cycle "3" of the decimal counter 64, the center section of the switch 120 is enabled to provide a reading of the propane fuel level on the output of the switch 120. Finally, during cycle "4" the output of the battery reserve operational amplifier 122 is passed through the upper section of the analog switch 120 to its output.

The output of the analog switch 120 is supplied to an analog-to-digital converter 127 which reconverts the analog information to a four bit parallel binary encoded digital output which is supplied to the multiplex system logic 52. This parallel output contains the necessary information for the data outputs of the multiplex system logic 52 to operate the digital display 31 when the system is in its "cycle" mode of operation.

The output of the analog switch 120 also is supplied to two comparator circuits 130 and 132, each of which have different reference levels applied to them. The comparator circuit 130 provides an output whenever the output of the analog switch circuit 120 is representative of a signal 75% or greater. Similarly, the output of the comparator circuit 132 provides an output whenever the signal appearing on the output of the analog switch 120 is representative of 25% or less. These signals are used in conjunction with the various cycling signals from the decimal counter 64 to operate the alarm logic circuit of the system.

The alarm logic illustrated in FIG. 5 includes six flip-flops 135, 136, 137, 138, 139 and 140. Assume initially that each of these flip-flops is in its reset condition of operation and that the system is being started up. Each time a pulse is applied to the decimal counter 64 to advance it from one decimal output to the next, the same pulse is applied to a one-shot multivibrator 142 (FIG. 3) which supplies an A/D start pulse on its output. This pulse is applied to the analog-to-digital converter 127 to cause that converter to read the output of the analog switch 120 which is present at the time the A/D start pulse appears. This pulse also is applied in parallel to six AND gates 142 through 147, each of which, respectively, has applied on its other input a different one of the outputs of the decimal counter cycle "0" through cycle "5".

Thus, coincident with the reading of cycle "0" from the digital-to-analog converter 115, which in turn is the reading of the fresh water tank 80, the AND gate 142 is enabled and a pulse is applied to the trigger input of the flip-flop 135. If no output is obtained from the comparator circuit 132 at this time, the flip-flop 135 remains in its reset condition and does not produce an output. This means that the water level is above 25%. If, on the other hand, the output of the comparator 132 is present, the flip-flop 135 is enabled; and the pulse applied from the output of the AND gate 142 sets the flip-flop. This in turn produces an output coupled to the upper one of four inputs to the upper section of a four pole, double-throw electronic switch circuit 150. Similarly, each of the flip-flops 135 through 140 are supplied with trigger pulses in sequence as the AND gates 142 through 147 are supplied with the cycle pulses from the output of the decimal counter 64 in sequence from cycle "0" through cycle "5".

The flip-flops 135, 138 and 139 are enabled to be set or not set in accordance with the output of the comparator 132. These are used to indicate an alarm condition for a low capacity for the water, propane and battery, respectively. Similarly, the flip-flops 136 and 137, which are representative of the alarm condition of the holding tanks 1 and 2, respectively, are enabled for being set by the output of the comparator 130 which, as stated previously, is present whenever the analog level is representative of a "75%" or more condition. This means that if the holding tanks are getting full, the corresponding flip-flop 136 or 137 is set to apply a corresponding input to the appropriate one of the four upper leads to the electronic switch 150.

When the system is in its normal automatic alarm monitoring condition of operation, the upper or "A" section of the switch 150 is effective to pass the signals appearing on its inputs directly on four outputs to the multiplex system logic 52 as indicated for the lowermost set of inputs to that logic in FIG. 3. The flip-flop 140 is used to indicate when the generator has a number of hours on it indicative of the time when maintenance of that generator should take place. As illustrated in FIG. 5, this is accomplished by supplying the output from the generator hours counter 60 to a generator hour decode circuit 155 which produces an enabling signal to the flip-flop 140 whenever a count of fifty hours is reached by the generator hours counter 60 (FIG. 3). The outputs of the flip-flops 139 and 140 are connected to the upper two inputs of the "A" section of a second four-pole double-throw electronic switch 156 which is the same as the switch 150. The other two inputs to the "A" section of the switch 156 are the thirty cycle per second clock pulse from the divider chain 54 (FIG. 3) and the "PM" logic signal which is obtained from the time of day clock 57 (FIG. 3).

If no alarm conditions exist, no inputs are applied to either of the sections "A" of the switches 150 and 156 and no output signals then are supplied to the multiplex logic circuit 52. On the other hand, if an alarm condition does exist, an output is present so long as the flip-flop representative of that alarm condition remains set. The system could operate so that the flip-flop remains set until the alarm condition is corrected, at which time a reset pulse would be applied to the flip-flop. As illustrated in FIG. 5, however, the flip-flops 135 through 140 are reset during each cycle of operation of the decimal counter a short time after they are each first set. For example, the flip-flop 135 is supplied with a trigger pulse capable of setting it from the output of the decimal counter corresponding to cycle "0". At cycle "5" a reset pulse is applied to that same flip-flop. Similarly, reset pulses are applied at cycles "6", "7", "8", "9" and "0" for the flip-flops 136 through 140, respectively. This causes the output signals applied to the appropriate inputs of the switches 150 to be present for a short period of time and then to go off until the next cycle of operation of the decimal counter 64 commences. The result of this, when the output of the multiplex system logic 52 is applied to the liquid crystal display logic, is that the indicia for the legends corresponding to the alarm condition flash on and off in a rolling sequence determined by the sequential operation of the flip-flops 135 to 140.

When the system is placed in its "cycle" mode of operation by closure of the switch 49, a positive potential is applied from the switch 49 (FIG. 3) to an input terminal 160 (FIG. 5) to enable the "B" sections of the electronic switches 150 and 156 and to disable by way of an inverter 161 the sections "A" of the switches. This means that the outputs of the switches to the multiplex logic 52 no longer are determined by the outputs of the flip-flops 135 through 140 but instead correspond to the lowermost four inputs to each of these switches as illustrated in FIG. 5. During this mode of operation, these outputs are obtained directly from the decimal counter 64 and are the respective cycle "0" through cycle "5" outputs. As explained above in conjunction with the operation of the circuit shown in FIG. 3, the decimal counter 64 produces the cycle outputs at four second intervals when it is operated in this mode; so that these signals appear on the respective ones of the four output leads from each of the switches 150 and 156 in the cycle mode of operation to force a four second display in a sequential order of the legend indicia on the display face 30 of the display panel 29.

Figure 6:
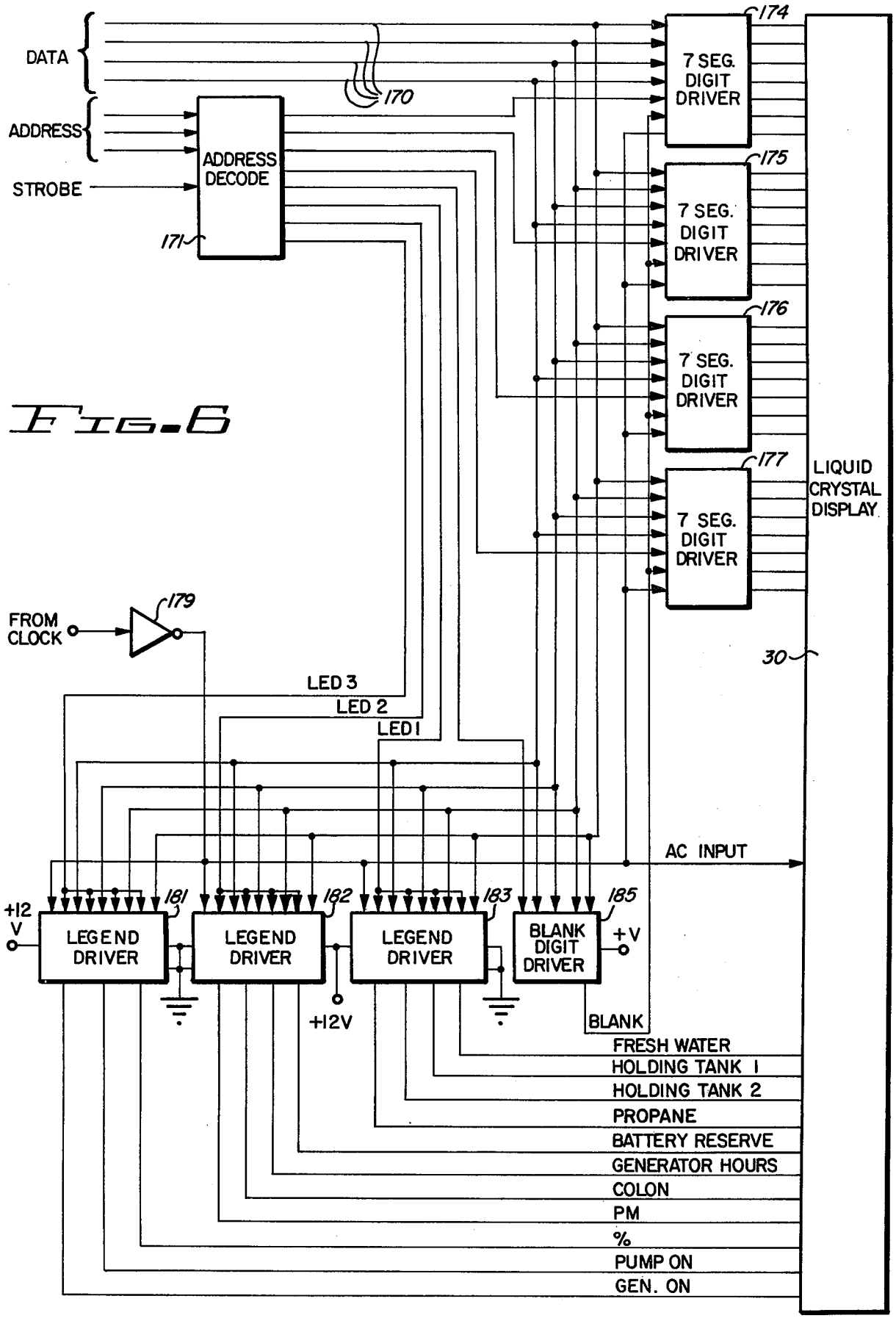

Refer now to FIG. 6. The data which is supplied at the output of the multiplex system logic 52 is four bit parallel binary encoded data indicative of the various data inputs which are supplied to the multiplex logic 52 from the time of day clock 57, the analog-to-digital converter 127 and the alarm logic switches 150 and 156. A parallel three bit address signal and a strobe or timing signal also is supplied to the display logic system of FIG. 6 from the multiplex system logic 52 (FIG. 3). The address and strobe information is derived from the clock signals supplied to the multiplex logic 52 from the crystal oscillator 51, so that this information is in synchronism with the information supplied to the multiplex logic 52 from the data inputs applied to it. The multiplex system logic has two different modes of operation, its automatic mode during which it supplies time of day and alarm information to the liquid crystal display panel 30, and the "cycle" mode of operation to which it is switched when the cycle switch 49 is closed. During this latter mode of operation, the data supplied on the four parallel data leads from the multiplex system logic 52 corresponds to the digital data from the analog-to-digital converter 127 and the generator hours counter for display by the system logic.

All of the digital data, whether it is four bit binary encoded data for decoding into digital numbers for display on the seven-segment display sections 31 of the liquid crystal display 30 or whether it is the individual encoded information for energizing the various indicia portions of the liquid crystal display such as, "propane", "fresh water", etc., is supplied over the four data leads 170. The address and strobe information from the multiplex logic 52 is supplied to an address decoder circuit 171 which continually cyclically scans four seven-segment digit driver/latch circuits 174, 175, 176 and 177. These are conventional seven-segment driver/latches for decoding the four bit binary information applied to their inputs into seven selected output signals for operating the time of day and percentage display digits 31 on the liquid crystal display 30.

The operation of the address decode circuit 171 is in synchronism with the presentation of the appropriate data on the data input leads 170 from the multiplex system logic. The manner in which the multiplex circuit operates to accomplish this is conventional and a number of different known multiplexing techniques may be employed to accomplish this. When the system is operating in its normal or automatic mode, data is supplied from the multiplex system logic on the leads 170 representative of the time of day, and the four digits 31 for displaying the time of day each are controlled by a different one of the seven-segment driver/latches 174 through 177. These driver/latches are energized for operation one at a time by the first four outputs of the address decode circuit 171 to control the liquid crystal display 30 for those digits 31.

It should be noted that alternating current signals applied to the back plane of the liquid crystal display 30 are obtained from the sixty cycle per second output of the clock driver chain 54 through a buffer inverter amplifier 170 which supplies these signals to the liquid crystal display 30 and to the seven-segment driver/latches 174 through 177, as well as to three legend driver/latches 181, 182, 183 and a blank digit driver/latch 185.

The outputs of the legend drivers are used to enable the appropriate legend or word displays of the liquid crystal display panel as indicated most clearly in FIG. 2. Each of these outputs is labelled in FIG. 6 with the same legend description which appears on the display of FIG. 2, so that a correlation between these outputs and the display is readily apparent.

The address decode circuit 171 also includes four outputs which sequentially enable the legend driver/latches 181, 182, 183 and the blank digit driver/latch 185, so that a continuous cyclical readout of the seven-segment driver/latches and the legend and blank digit driver/latch is effected so long as the system operates. This information is updated by the driver/latches when the inputs to these circuits change.

At any time that the data on the data input leads 170 is not present at the time the various drivers are energized, for example, in the normal operating conditions of the system when no alarm conditions exist in any of the functions being monitored, no data signals are applied to the appropriate display driver/latches at the time they are addressed by the address decode circuit 171. The legend driver/latches 181, 182 and 183 provide an output only when inputs are applied to the multiplex system logic 52 from the alarm logic indicating that an alarm condition exists. Thus, when all systems are operating normally, no outputs are obtained from the legend driver/latch circuits 181, 182 and 183 (except for the "colon" output and the "PM" output) at the appropriate times for display in conjunction with the clock display from the seven-segment digit driver/latches 174 through 177.

When the system is operating in its "cycle" mode of operation, the data on the leads 170 during the time the legend driver/latches 181 through 183 are addressed is obtained from the multiplex system logic 52 in response to the alarm logic circuit operating when the "B" sections of the switches 150 and 156 are enabled to supply the cycle "0" through cycle "5" signals sequentially from the decimal counter 64 to the multiplex system logic 52. This insures that as the legend driver/latches 181, 182 and 183 are sequentially addressed, the multiplex logic circuit causes outputs to appear from these legend driver/latches indicative of the various legends which have been shown. The legends "pump on" and "gen. on" appear whenever the pump or generator are operating irrespective of the mode of operation of the alarm logic circuit.

The blank digit driver/latch 185 is used in conjunction with the addressing of the legend driver/latches 181 through 183 to blank the seven-segment digit driver/latches 174 through 177 whenever the legend displays are being activated.

The foregoing description of the function monitoring system has been made in conjunction with the specific embodiment shown in the drawings. The particular logic configuration which has been employed is merely to be considered as illustrative, since various logic systems can be implemented to achieve the final result of the system so far as it is represented on the display panel 29. Also, much of the logic implementation which has been described may be effected by use of a microprocessor programmed to perform this same logic function with the end result of operating the liquid crystal display 30 in the same manner which has been described. In addition, although the system has been described in conjunction with a display which is a liquid crystal display, other types of displays could be employed if desired. Liquid crystal displays, however, are particularly well suited for this application; and if the system is used in the dark or at low light conditions, an incandescent lamp or other type of illumination can be provided for the face of the display so that it can be read.

Various modifications of the system, or different implementations of the logic to accomplish the same end result, will occur to those skilled in the art without departing from the scope of the invention as claimed.

We claim:

1. A function monitoring system including in combination:

a multi-digit digital display means for displaying digital data in response to input signals applied to at least one signal input thereof;

clock circuit means for generating time of day output signals on the output thereof;

function sensing means comprising a plurality of sensing means each sensing a different function and each providing a different output signal indicative of the condition of the function being sensed thereby;

function display means for displaying legends representative of different functions monitored by the system;

function monitoring means coupled to each of said plurality of sensing means and coupled to said function display means for selectively causing said function display means to display particular legends as controlled by said function monitoring means; and means for selectively coupling the outputs of said clock circuit means and said function monitoring means to the signal input of said digital display means for selectively displaying digital time of day and digital function data as controlled by said function monitoring means.

2. The combination according to claim 1 wherein said function monitoring means includes alarm system means coupled to said function display means for selectively enabling said function display means under the control of said function monitoring means in response to predetermined conditions of the functions being monitored by the function monitoring system.

3. The combination according to claim 2 wherein said alarm system means selectively and sequentially enables said function display means to display legends representative of different functions monitored by the system in a pre-determined repeating sequential pattern in response to said pre-determined conditions of the function being monitored by the function monitoring system.

4. The combination according to claim 1 wherein said function monitoring means includes alarm system means coupled to said function display means for selectively enabling said function display means under the control of said function monitoring means in response to predetermined conditions of the functions being monitored by the function monitoring system.

5. The combination according to claim 1 wherein said multidigit digital display means and said function display means are located on a common display panel.

6. The combination according to claim 5 wherein said coupling means is selectively operated to cause said function monitoring system to control said digital display means and said function display means in a step-by-step manner to display digital function data on said digital display means corresponding to a function being monitored and displayed on said function display means for different functions in accordance with a predetermined cycle of operation.

7. The combination according to claim 6 further including means for causing said digital display means to display time of day signals thereon upon termination of a cycle of operation of said function monitoring system.

8. The combination according to claim 7 wherein said function monitoring means includes alarm system means coupled to said function display means for selectively enabling said function display means under the control of said function monitoring means in response to predetermined conditions of the functions being monitored by the function monitoring means while said digital display menas simultaneously is controlled by said clock circuit means for displaying the time of day thereon.

* * * * *